US010995778B2

(12) United States Patent
Kawabuchi et al.

(10) Patent No.: US 10,995,778 B2
(45) Date of Patent: May 4, 2021

(54) HYDRAULIC SYSTEM AND EMERGENCY OPERATION METHOD

(71) Applicant: TADANO LTD., Kagawa (JP)

(72) Inventors: Naoto Kawabuchi, Kagawa (JP); Naofumi Yoshida, Kagawa (JP); Naotaka Masuda, Kagawa (JP); Yasuhiro Fukumori, Kagawa (JP)

(73) Assignee: TADANO LTD., Kagawa (JP)

( * ) Notice: Subject to any disclaimer, the term of this patent is extended or adjusted under 35 U.S.C. 154(b) by 321 days.

(21) Appl. No.: 16/089,718

(22) PCT Filed: Mar. 31, 2017

(86) PCT No.: PCT/JP2017/013645
§ 371 (c)(1),
(2) Date: Sep. 28, 2018

(87) PCT Pub. No.: WO2017/171021
PCT Pub. Date: Oct. 5, 2017

(65) Prior Publication Data

US 2020/0309166 A1 Oct. 1, 2020

(30) Foreign Application Priority Data

Mar. 31, 2016 (JP) ..... JP2016-070733

(51) Int. Cl.
*F15B 20/00* (2006.01)
*F15B 21/08* (2006.01)

(52) U.S. Cl.
CPC ..... *F15B 20/002* (2013.01); *F15B 21/08* (2013.01); *F15B 2211/20523* (2013.01); *F15B 2211/6346* (2013.01); *F15B 2211/6355* (2013.01)

(58) Field of Classification Search
CPC ..... F15B 20/002; F15B 21/08; F15B 2211/20523; F15B 2211/6346; F15B 2211/6355
See application file for complete search history.

(56) References Cited

U.S. PATENT DOCUMENTS 6,393,838 B1 * 5/2002 Moriya ..... F15B 11/163 60/422
7,036,308 B2 * 5/2006 Rollmann ..... B66F 9/22 60/422

(Continued)

FOREIGN PATENT DOCUMENTS

JP 2000-344466 A 12/2000
WO WO 2014/137250 A1 9/2014

OTHER PUBLICATIONS

Jun. 6, 2017, International Search Report issued for related PCT application No. PCT/JP2017/013645.

(Continued)

*Primary Examiner* — Thomas E Lazo
(74) *Attorney, Agent, or Firm* — Paratas Law Group, PLLC

(57) ABSTRACT

This hydraulic system is provided with: a hydraulic pump; a pilot-type control valve; an electromagnetic proportional valve; a controller; and a pilot pressure switching unit which is capable of switching the electromagnetic proportional valve supply pressure to a first pressure during a normal operation, or to a second pressure lower than the first pressure. The control valve is provided with a bleed-off passage, and is capable of controlling the operating oil pressure supplied to the actuator, according to the opening area thereof. During an emergency operation, the electromagnetic proportional valve supply pressure is switched from the first pressure to the second pressure, the electromagnetic proportional valve is brought into a fully opened (Continued)

state, and the operating oil discharge amount from the hydraulic pump increases and decreases, and the operating oil pressure increases and decreases, and thus the operating speed of the actuator is controlled.

5 Claims, 7 Drawing Sheets

(56) References Cited

U.S. PATENT DOCUMENTS

| | | | | |
|---|---|---|---|---|
| 8,495,870 | B2 * | 7/2013 | Sumiyoshi | E02F 9/2235 60/444 |
| 8,554,401 | B2 * | 10/2013 | Satake | E02F 9/2285 701/29.1 |
| 9,174,562 | B2 * | 11/2015 | Uozu | F15B 11/024 |
| 9,382,923 | B2 * | 7/2016 | Carlin | F15B 1/04 |
| 9,903,098 | B2 * | 2/2018 | Vigholm | F15B 13/0433 |
| 2016/0145835 | A1 * | 5/2016 | Kim | E02F 9/26 60/327 |

OTHER PUBLICATIONS

Jun. 6, 2017, International Search Opinion issued for related PCT application No. PCT/JP2017/013645.
Oct. 7, 2019, European Search Report issued for related EP Application No. 17775552.7.

* cited by examiner

--Prior Art--

HYDRAULIC SYSTEM AND EMERGENCY OPERATION METHOD

CROSS REFERENCE TO PRIOR APPLICATION

This application is a National Stage Patent Application of PCT International Patent Application No. PCT/JP2017/013645 (filed on Mar. 31, 2017) under 35 U.S.C. § 371, which claims priority to Japanese Patent Application No. 2016-070733 (filed on Mar. 31, 2016), which are all hereby incorporated by reference in their entirety.

TECHNICAL FIELD

The present invention relates to a hydraulic system including an electric operation system and an emergency operation method, and in particular, to a technique which can respond during an emergency operation where control of an electromagnetic proportional valve by a controller is not possible.

BACKGROUND ART

In recent years, an electric operation system which electrically controls a control valve of a hydraulic system is mounted on an operating system of a hydraulic working machine. In the electric operation system, an operation signal from an operation lever is input to the controller, and an electromagnetic proportional valve is operated according to a drive signal from the controller. By the operation of the electromagnetic proportional valve, a pilot pressure of the control valve of the hydraulic system is controlled.

The electric operation system can perform advanced control by executing a control logic in the controller and is an important technique for realizing energy saving, low noise, optimum control, and the like which are required for hydraulic working machine in recent years.

In the electric operation system, when an electric circuit unit breaks down, the controller cannot control the electromagnetic proportional valve. Therefore, it is preferable that the electric operation system has an emergency operation device for responding during a failure of the electric operation system (for example, Patent Literature 1). An example of the electric operation system including the emergency operation device is illustrated in FIG. 7.

In the electric operation system illustrated in FIG. 7, during a normal operation, when an operation lever 9 of an operation box 20 is operated, a drive signal based on the operation thereof is output from a controller 2 and input to an electromagnetic proportional valve 4 via an amplifier 3. When the electromagnetic proportional valve 4 operates and a pilot pressure is supplied to a control valve 27, a spool of the control valve 27 moves, and an operating oil pressure is supplied to an actuator 5. Thereby, a drive direction and an operation speed of the actuator 5 are controlled.

When a failure such as disconnection occurs in an electric circuit unit of the electric operation system, a power supply switching switch 22 is switched to an emergency operation side. An emergency operation switch 21 incorporated in the operation box 20 is switched in conjunction with an operation of the operation lever 9 and when a side of the electromagnetic proportional valve 4 is energized, a pilot pressure is supplied to the control valve 27, and the actuator 5 is driven.

CITATION LIST

Patent Literature

Patent Literature 1: JP 2000-344466 A

SUMMARY OF THE INVENTION

Problems to be Solved by the Invention

However, in the emergency operation device described above, since the electromagnetic proportional valve 4 is switched to ON (fully opened) or OFF (fully closed), there is a problem that the electromagnetic proportional valve 4 is in the fully opened state during an emergency operation, the actuator 5 is suddenly operated or suddenly stopped, and a shock is generated.

On the other hand, an electromagnetic proportional valve with an emergency manual operation function is known for a case where the electromagnetic proportional valve does not work by electricity by the electromagnetic proportional valve being disconnected or the electromagnetic proportional valve itself being stuck due to contamination (mixing of impurities). Even in the electromagnetic proportional valve with the emergency manual operation function, since the electromagnetic proportional valve is manually fully opened during the emergency operation, similarly, there is also a problem that the actuator is suddenly operated and shock is generated during the emergency operation.

An object of the present invention is to provide a hydraulic system and an emergency operation method which can slowly drive an actuator during an emergency operation and are excellent in safety.

Solutions to Problems

A hydraulic system according to the present invention includes:

- a hydraulic pump;
- a pilot-type control valve which supplies an operating oil pressure from the hydraulic pump to an actuator of a working machine;
- an electromagnetic proportional valve which supplies a pilot pressure to the control valve;
- an operation lever which receives an operation for operating the actuator;
- a controller which controls the electromagnetic proportional valve based on an operation signal from the operation lever; and
- a pilot pressure switching unit in which an electromagnetic proportional valve supply pressure supplied from a pilot pressure source to the electromagnetic proportional valve is capable of being switched to a first pressure during a normal operation or a second pressure lower than the first pressure, wherein the control valve has a bleed-off passage whose opening area increases and decreases according to a stroke of a spool based on a pilot pressure, and is capable of controlling the operating oil pressure to be supplied to the actuator according to the opening area, the second pressure is set such that the operating oil pressure is equal to or lower than a predetermined pressure when the electromagnetic proportional valve supply pressure is switched to the second pressure in a state where an operating oil discharge amount of the hydraulic pump is the minimum discharge amount, the pilot pressure switching unit switches the electromagnetic proportional valve supply pressure from the first pressure to the second pressure during an emergency operation in which the controller is not capable of controlling the electromagnetic proportional valve, the electromagnetic proportional valve is brought into a fully opened state during the emergency operation, and as the operating oil discharge amount from the hydraulic pump increases and decreases, the operating oil pressure increases and decreases, and an operation speed of the actuator is controlled.

An emergency operation method according to the present invention is an emergency operation method of a hydraulic system, wherein the hydraulic system includes:

a hydraulic pump;

a pilot-type control valve which supplies an operating oil pressure from the hydraulic pump to an actuator of a working machine;

an electromagnetic proportional valve which supplies a pilot pressure to the control valve;

an operation lever which receives an operation for operating the actuator;

a controller which controls the electromagnetic proportional valve based on an operation signal from the operation lever; and a pilot pressure switching unit in which an electromagnetic proportional valve supply pressure supplied from a pilot pressure source to the electromagnetic proportional valve is capable of being switched to a first pressure during a normal operation or a second pressure lower than the first pressure, the control valve has a bleed-off passage whose opening area increases and decreases according to a stroke of a spool based on a pilot pressure, and is capable of controlling the operating oil pressure to be supplied to the actuator according to the opening area, the second pressure is set such that the operating oil pressure is equal to or lower than a predetermined pressure when the electromagnetic proportional valve supply pressure is switched to the second pressure in a state where an operating oil discharge amount of the hydraulic pump is the minimum discharge amount, and the emergency operation method includes:

a step of bringing the electromagnetic proportional valve into a fully opened state;

a step of switching the electromagnetic proportional valve supply pressure from the first pressure to the second pressure during an emergency operation in which the controller is not capable of controlling the electromagnetic proportional valve; and a step of, by increasing and decreasing the operating oil discharge amount from the hydraulic pump, increasing and decreasing the operating oil pressure and controlling an operation speed of the actuator.

Effects of the Invention

According to the present invention, a hydraulic system and an emergency operation method are provided which can slowly drive an actuator during an emergency operation and are excellent in safety.

DESCRIPTION OF EMBODIMENTS

[Normal Operation of Hydraulic System 1]

Figure 1:
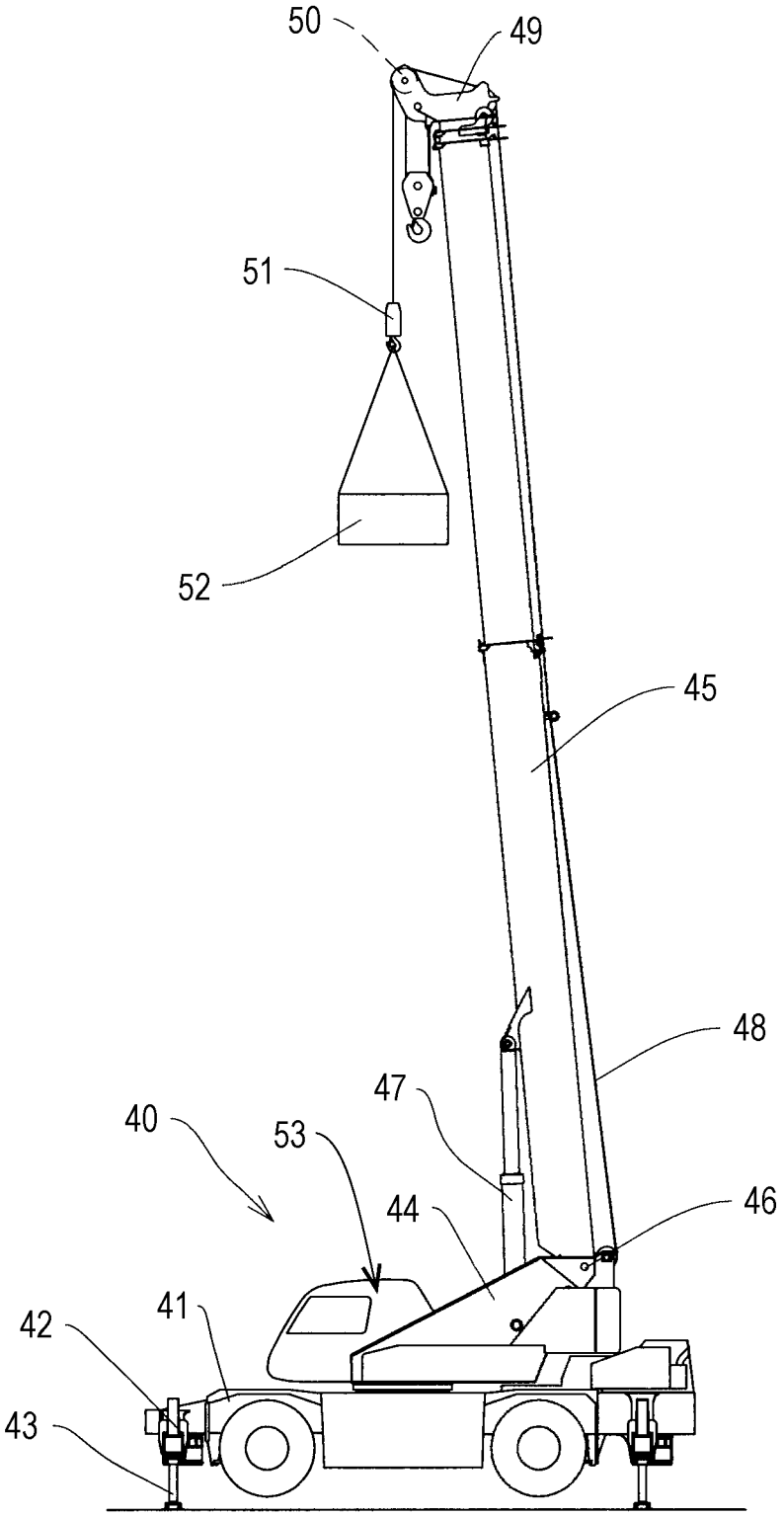
FIG. 1 is a view illustrating a mobile crane suitable as a working machine on which a hydraulic system according to the present invention is mounted.

FIG. 1 is a view illustrating a state of a mobile crane 40 suitable as a working machine on which a hydraulic system 60 (see FIG. 2) according to the present invention is mounted during a crane operation. In FIG. 1, in the mobile crane 40, jack cylinders 43 of outriggers 42 provided at the front and rear of a lower frame 41 extend, and the mobile crane 40 is in a crane working posture in which the entire mobile crane 40 is jacked up.

A rotation frame 44 is mounted on an upper surface of the lower frame 41 so as to be freely rotated. A telescopic boom 45 is connected to the rotation frame 44 by a pin 46 so as to be freely raised and lowered. The telescopic boom 45 is driven to be telescopic by a telescopic cylinder (not illustrated) disposed therein. In addition, the telescopic boom 45 is driven to be raised and lowered by a raising and lowering cylinder 47 interposed between the rotation frame 44 and the telescopic boom 45.

A wire rope 48 is unwounded from a winch (not illustrated) disposed in the rotation frame 44 and led to a telescopic boom tip 49 along the rear surface of the telescopic boom 45. Further, the wire rope 48 is wounded around a sheave 50 of the telescopic boom tip 49, and a hook 51 is suspended at a tip of the wire rope 48. A suspended load 52 is suspended from the hook 51.

Figure 2:
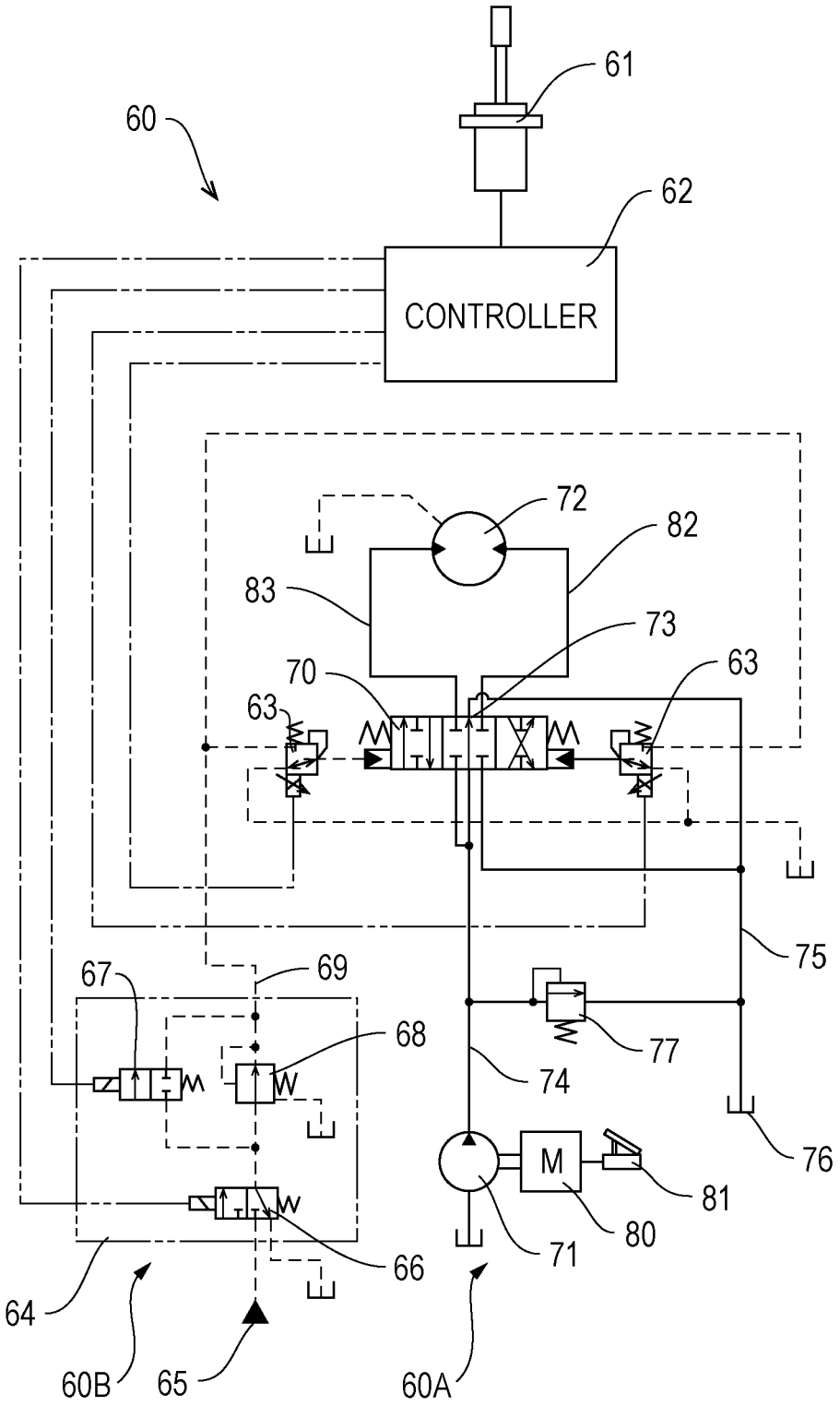
FIG. 2 is a diagram illustrating an example of the hydraulic system mounted on a mobile crane.

FIG. 2 is a diagram illustrating an example of a hydraulic system mounted on the mobile crane 40. FIG. 2 illustrates a control system of an electric operation system in a case where an electric circuit is not broken down, that is, during a normal operation.

The hydraulic system 60 includes a main circuit 60A which supplies a working pressure to an actuator 72 and a pilot circuit 60B which supplies a pilot pressure to a control valve 70 of the main circuit 60A. The main circuit 60A includes a hydraulic pump 71, the control valve 70, a pump oil passage 74, a tank oil passage 75, an operating oil tank 76, a relief valve 77, an engine 80, and an accelerator 81. The pilot circuit 60B has an operation lever 61, a controller 62, an electromagnetic proportional valve 63, a pilot pressure switching unit 64, a pilot pressure source 65, a pilot oil passage 69, and an emergency operation circuit 84 (see FIG. 3).

The operation lever 61 converts an operation direction and an operation amount into an operation signal (electric signal) and outputs the operation signal to the controller 62. The controller 62 receives an operation signal from the operation lever 61 and outputs a drive signal (electric signal) to the corresponding electromagnetic proportional valve 63.

The electromagnetic proportional valve 63 receives the drive signal from the controller 62, generates a pilot pressure proportional to the drive signal, and supplies the pilot pressure to the control valve 70. It is preferable that the electromagnetic proportional valve 63 has a detent type emergency manual operation function. Thus, even in a case where the electromagnetic proportional valve 63 itself breaks down, it is possible to respond safely.

The control valve 70 is a pilot-type directional control valve whose drive direction is switched by a pilot pressure from the electromagnetic proportional valve 63 and which controls an operating oil pressure from the hydraulic pump 71 and supplies the operating oil pressure to the actuator 72. The actuator 72 is, for example, a hydraulic motor for rotation. The actuator 72 is not limited to a hydraulic motor but may be a hydraulic cylinder.

As illustrated in FIG. 2, the control valve 70 includes a bleed-off passage 73 whose opening area (bleed-off passage area) decreases as a stroke (switching stroke) of the spool based on a pilot pressure from the electromagnetic proportional valve 63 increases. By controlling a flow rate of an operating oil which returns to the operating oil tank 76 according to the opening area of the bleed-off passage 73, it is possible to control a flow rate of an operating oil which is supplied to the control valve 70, and consequently a flow rate of an operating oil which is supplied to the actuator 72.

The pump oil passage 74 connects the hydraulic pump 71 and the control valve 70. The tank oil passage 75 connects the control valve 70 and the operating oil tank 76. The relief valve 77 is interposed between the pump oil passage 74 and the tank oil passage 75 and operates when an oil pressure exceeds the set pressure to prevent an abnormal rise in pressure.

The hydraulic pump 71 is, for example, a fixed displacement type hydraulic pump and is driven by the power of the engine 80 of the mobile crane 40. The rotational speed of the engine 80 is controlled by the operation of the accelerator 81.

The pilot pressure switching unit 64 includes a first electromagnetic switching valve 66, a second electromagnetic switching valve 67, and a decompression valve 68. The pilot oil passage 69 connects the pilot pressure switching unit 64 and the electromagnetic proportional valves 63 and 63 to each other. The pilot pressure switching unit 64 is switched by a drive signal from the controller 62 and supplies the electromagnetic proportional valve supply pressure of the pilot pressure source 65 to the pilot oil passage 69 as it is or under reduced pressure.

The first electromagnetic switching valve 66 is a three-port two-position switching valve, and the first electromagnetic switching valve 66 is in a blocking position which blocks the pilot pressure source 65 and the pilot oil passage 69 when not energized and is switched to a communication position which communicates the pilot pressure source 65 and the pilot oil passage 69 with each other when energized. The second electromagnetic switching valve 67 is a two-port two-position switching valve, and the second electromagnetic switching valve 67 is in the blocking position when not energized and is switched to the communication position which bypasses the decompression valve 68 and communicates when energized. The set pressure of the decompression valve 68 will be described in detail by an emergency operation to be described later.

The normal operation of the hydraulic system 60 described above is as follows.

When the operation lever 61 is operated by an operator, the controller 62 receives the operation signal thereof. The controller 62 energizes the first electromagnetic switching valve 66 and the second electromagnetic switching valve 67 of the pilot pressure switching unit 64 based on the operation signal.

Both the first electromagnetic switching valve 66 and the second electromagnetic switching valve 67 are switched to the communication position and the electromagnetic proportional valve supply pressure from the pilot pressure source 65 passes through the first electromagnetic switching valve 66 and the second electromagnetic switching valve 67 and is supplied to the pilot oil passage 69 without being decompressed. Then, the electromagnetic proportional valve supply pressure (first pressure) that is not decompressed is supplied to the electromagnetic proportional valve 63 via the pilot oil passage 69.

In addition, the controller 62 outputs a drive signal corresponding to an operation amount to the electromagnetic proportional valve 63 corresponding to the operation direction of the operation lever 61. Upon receiving the drive signal, the electromagnetic proportional valve 63 generates the pilot pressure proportional to the drive signal and supplies a pilot pressure to the control valve 70. As described above, the drive direction and the stroke of the spool (valve body) of the control valve 70 are controlled according to the operation direction and the operation amount of the operation lever 61.

The operating oil discharged from the hydraulic pump 71 is supplied to the control valve 70 via the pump oil passage 74, and a portion of the operating oil flows to the bleed-off passage 73 and returns to the operating oil tank 76 via the tank oil passage 75. The remaining operating oil flows to the actuator oil passage 82 (or 83) in the switched direction and drives the actuator 72 (rotation motor). The operating oil that drives the actuator 72 returns to the control valve 70 via the opposite actuator oil passage 83 (or 82), and returns to the operating oil tank 76 via the tank oil passage 75.

At this time, when the rotational speed of the engine 80 increases and decreases by operating the accelerator 81, the operating oil discharge amount by the hydraulic pump 71 increases and decreases. The flow rate of the operating oil flowing from the control valve 70 to the actuator 72 also increases and decreases so that the operating speed of the actuator 72 can increase and decrease. Incidentally, during the normal operation, the engine 80 is in the idling state, and the operating oil discharge amount from the hydraulic pump 71 is the minimum discharge amount.

As described above, in the hydraulic system 60, the direction and the speed of the operation of the actuator 72 can be controlled by switching the drive direction of the control valve 70 by the operation lever 61 and operating the accelerator 81.

[Emergency Operation of Hydraulic System 60 (in a Case where the Electric Circuit Breaks Down)]

Figure 3:
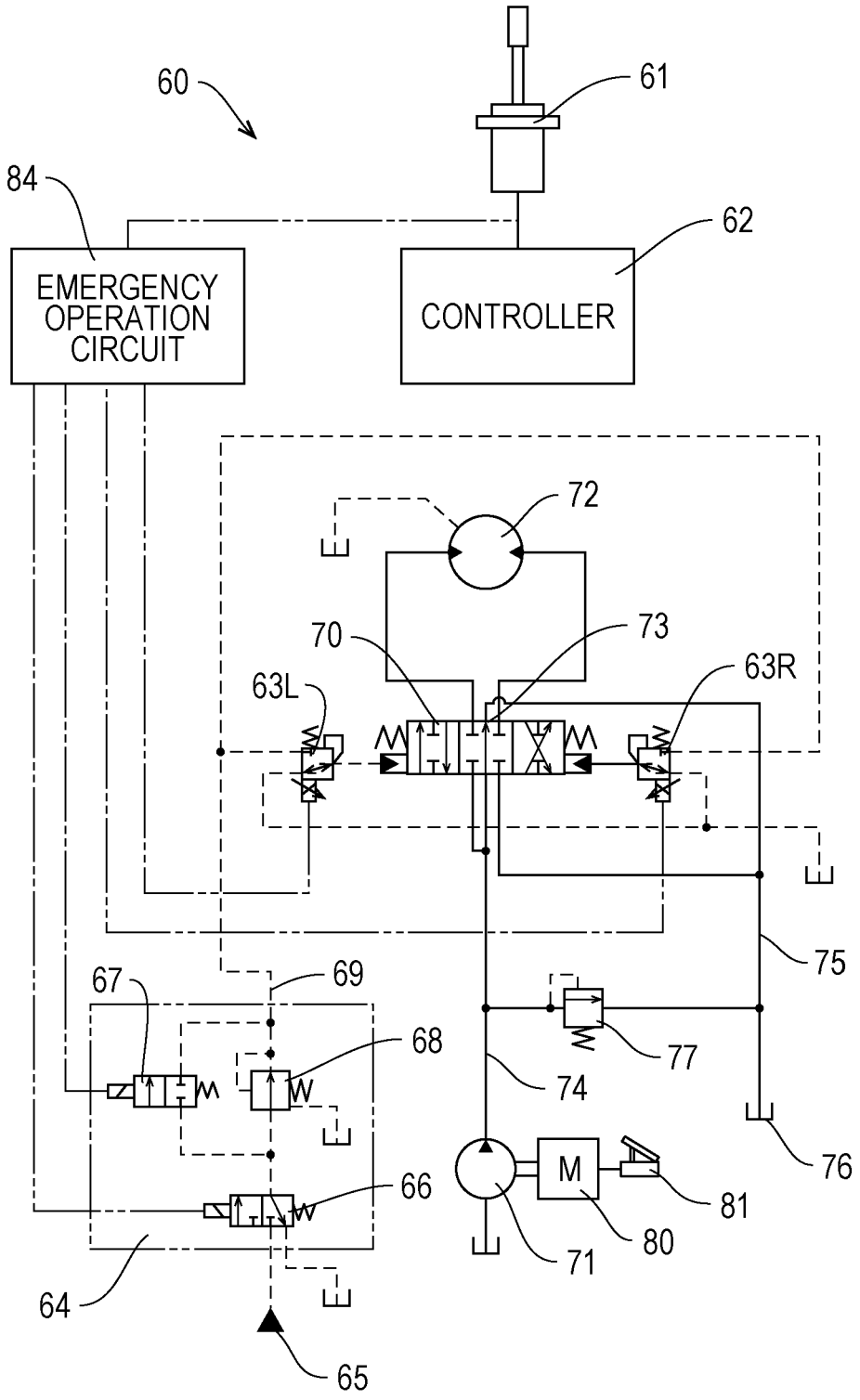
FIG. 3 is a diagram illustrating an example of a control system of an electric operation system in a case where an electric circuit breaks down.

FIG. 3 is a diagram illustrating a control system of the electric operation system in a case where the electric circuit breaks down, that is, during the emergency operation. As a case where the electric circuit breaks down, a case where a portion (potentiometer or the like corresponds) that converts the operation amount of the operation lever 61 into an operating electric signal breaks down, or a case where the controller 62 breaks down is considered.

As illustrated in FIG. 3, in a case where the electric circuit breaks down, a signal transmission passage from the controller 62 to the first electromagnetic switching valve 66, the second electromagnetic switching valve 67, and electromagnetic proportional valves 63L and 63R is blocked, and the control of the first electromagnetic switching valve 66, the second electromagnetic switching valve 67, and the electromagnetic proportional valves 63L and 63R is performed by the emergency operation circuit 84.

The emergency operation circuit 84 receives only the electric signal indicating the operation direction among the operation signals output from the operation lever 61 and outputs the drive signal to the corresponding electromagnetic proportional valve 63R or 63L. Other configurations of the hydraulic system 60 are the same as those in the normal state described with reference to FIG. 2, so that the description thereof is omitted.

Figure 7:
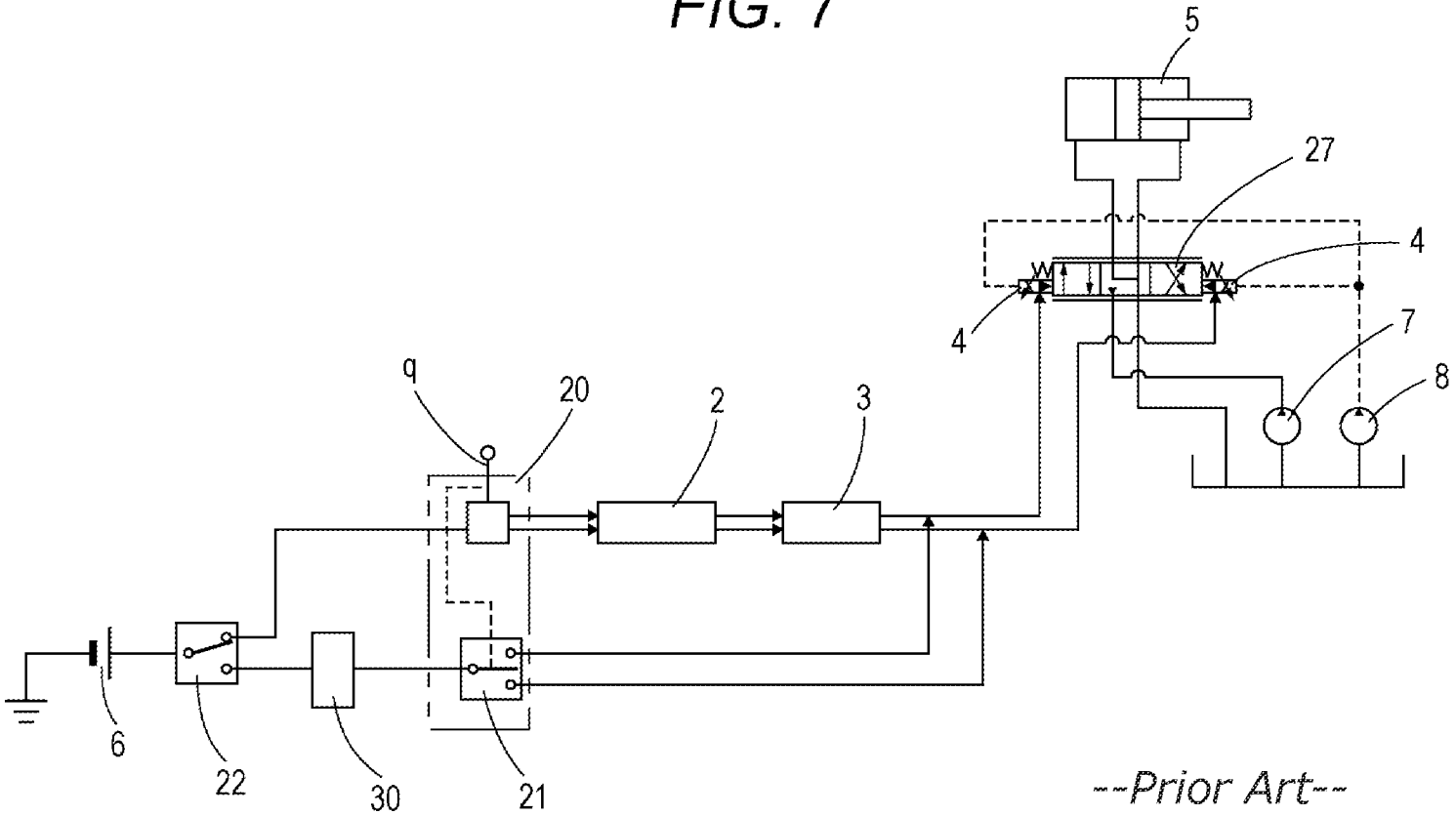
FIG. 7 is a diagram illustrating a hydraulic system including an emergency operation device of the related art.

In the related art, in a case where an electric circuit of an electric operation system breaks down, an emergency operation is performed by an emergency operation device (see FIG. 7). In a case where the emergency operation is performed by the emergency operation device of the related art, the electromagnetic proportional valve is controlled so as to be fully opened, so that the actuator 72 is suddenly operated. In a case where the actuator 72 is a rotation motor, the rotation is performed suddenly. In particular, in a case where the emergency operation is performed in the mobile crane 40 in the working posture illustrated in FIG. 1, the suspended load 52 lifted at a high level is rotated and swings largely and strikes the telescopic boom 45, which is extremely dangerous. In contrast, the hydraulic system 60 of the present embodiment is remarkably safe since the emergency operation is performed as follows.

In other words, during the emergency operation, the operator switches the control system of the electric operation system from the control system during the normal operation illustrated in FIG. 2 to the control system at the emergency operation illustrated in FIG. 3, and then the operation of the operation lever 61 is performed. Specifically, the operator operates the operation lever (rotation lever) 61 in a direction corresponding to the rotation direction. The emergency operation circuit 84 outputs a drive signal to the corresponding electromagnetic proportional valve 63 based on an operation signal indicating the operation direction from the operation lever 61. Accordingly, the corresponding electromagnetic proportional valve 63 is fully opened. For example, when the operator operates the operation lever 61 in the left rotation direction, the electromagnetic proportional valve 63L for the left rotation is fully opened.

At the same time, the emergency operation circuit 84 energizes the first electromagnetic switching valve 66 of the pilot pressure switching unit 64. At this time, the second electromagnetic switching valve 67 is in a de-energized state and is maintained at the blocking position. The electromagnetic proportional valve supply pressure of the pilot pressure source 65 is decompressed by passing through the first electromagnetic switching valve 66 and the decompression valve 68 to be supplied to the pilot oil passage 69 since only the first electromagnetic switching valve 66 is switched to the communication position. Then, the decompressed pilot pressure (hereinafter, referred to as "decompression pilot pressure") is supplied to the control valve 70 from the pilot oil passage 69 via the electromagnetic proportional valve 63L (for left rotation) of a fully opened state.

Figure 4:
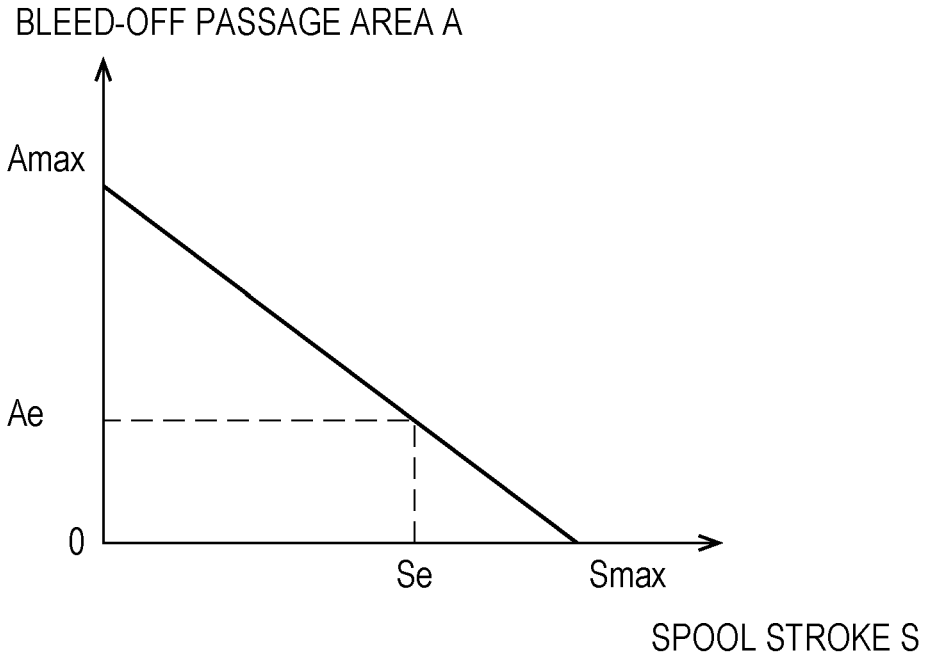
FIG. 4 is a graph illustrating a relationship between a bleed-off passage area and a spool stroke of a control valve.

FIG. 4 is a graph illustrating the relationship between a bleed-off passage area A and a spool stroke S of the control valve 70. The bleed-off passage area A is the maximum (Amax) when the spool stroke S is zero, decreases as the spool stroke S increases, and becomes zero when the spool stroke S is the maximum (Smax).

As illustrated in the graph of FIG. 4, when the decompression pilot pressure is supplied to the control valve 70 in the hydraulic system 60 of FIG. 3, the spool stroke S is lower than the maximum stroke (Smax) which is referred to as Se. At this time, the bleed-off passage area A of the control valve 70 is referred to as Ae.

Figure 5:
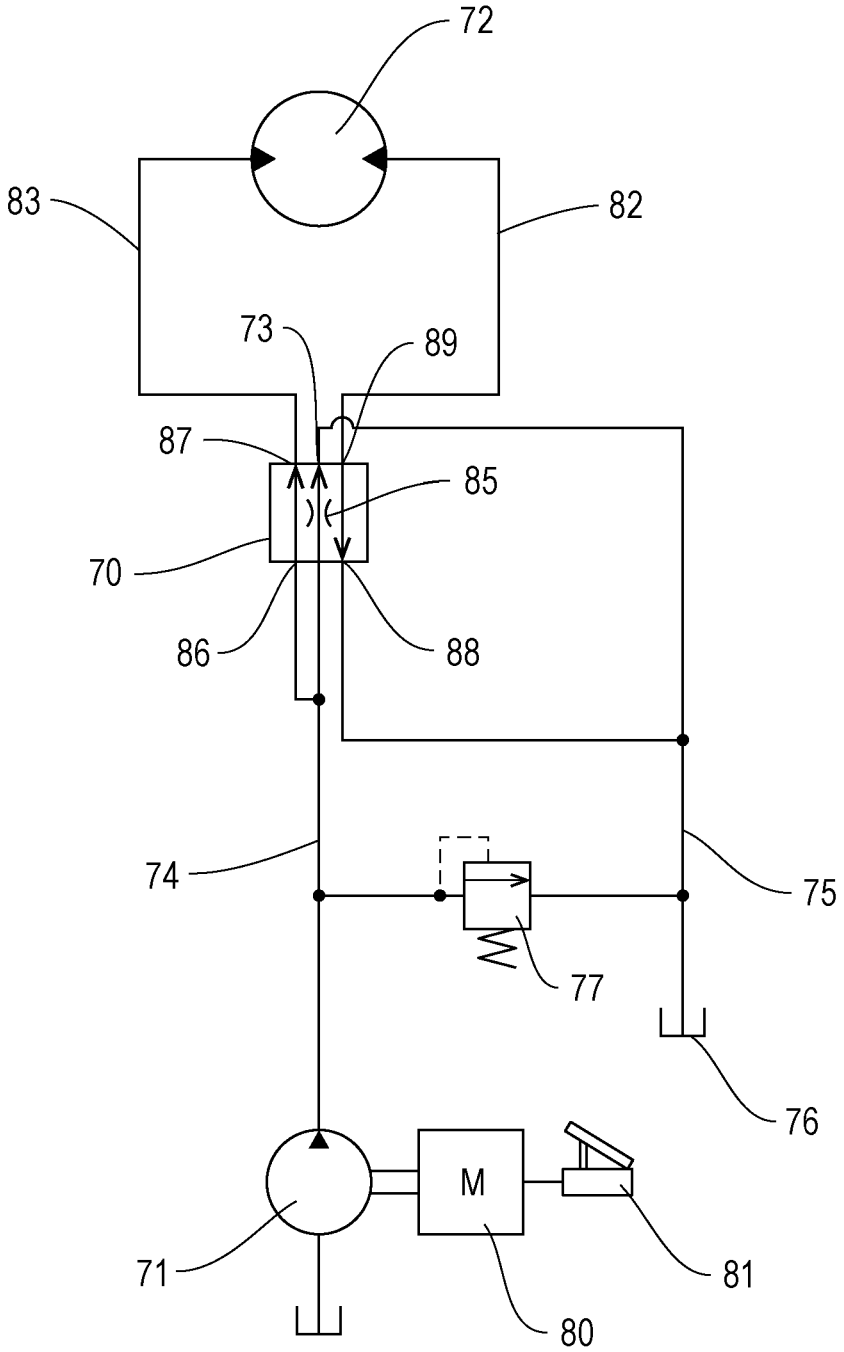
FIG. 5 is a diagram for describing a state of a bleed-off circuit including the bleed-off passage when a decompression pilot pressure is supplied to the control valve.

FIG. 5 is a diagram for describing a state of the bleed-off circuit including the bleed-off passage 73 when the decompression pilot pressure is supplied to the control valve 70. FIG. 5 illustrates a state where the accelerator 81 is not depressed and the engine 80 is in the idling state.

In the idling state, the engine 80 is rotated at the required minimum rotational speed, and the operating oil discharge amount of the fixed displacement type hydraulic pump 71 is the minimum discharge amount. The operating oil discharged from the hydraulic pump 71 passes through the bleed-off passage 73 of the control valve 70 via the pump oil passage 74, and then returns to the operating oil tank 76 via the tank oil passage 75.

In a state where the decompression pilot pressure is being supplied to the control valve 70, as illustrated in FIG. 4, the bleed-off passage area is narrowed down to Ae with respect to the maximum Amax. In other words, as illustrated by the symbol of the control valve 70 in FIG. 5, a throttle 85 is provided in the bleed-off passage 73. As the operating oil with the minimum discharge amount during idling passes through the throttle 85, a pump pressure Pp (operating oil pressure) is generated in the pump oil passage 74.

On the other hand, since an operating pressure Pm (hereinafter referred to as "actuator operating pressure Pm" or "operating pressure Pm during activation") during activation of the actuator 72 (hereinafter referred to as "hydraulic motor 72 for rotation") is higher than the pump pressure Pp during the idling in FIG. 5, in this state, the hydraulic motor 72 for rotation does not rotate. In other words, in the idling state, the bleed-off passage area Ae is set such that the pump pressure Pp which is slightly lower than the operating pressure Pm at the activation of the hydraulic motor 72 for rotation is generated when the operating oil with the minimum discharge amount passes through the bleed-off passage 73. In other words, based on the stroke of the spool corresponding to the bleed-off passage area Ae, the decompression pilot pressure, that is, the set pressure (second pressure) of the decompression valve 68 is set.

From a state illustrated in FIG. 5, when, by depressing the accelerator 81, the rotational speed of the engine 80 gradually increases, the discharge amount of the hydraulic pump 71 increases. Then, since the flow rate of the operating oil passing through the throttle 85 of the bleed-off passage 73 of the control valve 70 increases, the pump pressure Pp gradually increases. When the pump pressure Pp exceeds the operating pressure Pm during the activation of the hydraulic motor 72 for rotation, the hydraulic motor 72 for rotation starts to rotate. The operating oil in the pump oil passage 74 also starts to flow from a P port 86 to an A port 87 of the control valve 70, passes through the actuator oil passage 83, the hydraulic motor 72 for rotation, and the actuator oil passage 82, and returns to a B port 89 of the control valve 70. The operating oil returned to the B port 89 merges into the tank oil passage 75 via a T port 88 of the control valve 70 and returns to the operating oil tank 76.

Since the throttle 85 of the bleed-off passage 73 of the control valve 70 described above can be considered as an orifice, the above operation will be described by applying to the formula of orifice pressure loss.

Formula of orifice pressure loss: $\Delta P = 0.26(Q/a)^2$

ΔP: orifice pressure loss [MPa]
Q: Orifice flow rate [L/min]
a: orifice area [$mm^2$]

In the formula of orifice pressure loss, in a case where an orifice flow rate Q1 during the idling is 20 [L/mm$^2$], an orifice flow rate Q2 during the accelerator operation is 40 [L/mm$^2$], and an orifice area a is 5 [mm$^2$], the pump pressure Pp (orifice pressure loss ΔP) is calculated as follows. In addition, in a case where the rotation motor activation pressure Pm is 5 [MPa], the relationship between the pump pressure Pp and the rotation motor activation pressure Pm is also illustrated.

(1) The pump pressure Pp (orifice pressure loss ΔP) during the idling is $$Pp=0.26\times(20/5)^2\approx4.16\ [\text{MPa}]<5\ [\text{MPa}]$$

Therefore, during the idling, since the pump pressure Pp is lower than the rotation motor activation pressure Pm, the hydraulic motor 72 for rotation does not rotate.

(2) On the other hand, the pump pressure Pp (orifice pressure loss ΔP) during the accelerator operation is $$Pp=0.26\times(40/5)^2\times16.64\ [\text{Mpa}]>5\ [\text{MPa}]$$

Therefore, during the accelerator operation, since the pump pressure Pp becomes higher than the rotation motor activation pressure Pm, the hydraulic motor 72 for rotation rotates.

As described above, in the hydraulic system 60, when further decompressed pilot pressure is applied to the control valve 70 including the bleed-off passage 73 as compared with a pilot pressure during the normal operation, the control valve 70 can be switched to such an extent that the pump pressure Pp generated by the operating oil passing through the bleed-off passage 73 of the control valve 70 does not exceed the actuator operating pressure Pm during the idling. In addition, when a pump discharge amount Q increases, the pump pressure Pp generated by the operating oil passing through the bleed-off passage 73 of the control valve 70 increases. Accordingly, since the pump pressure Pp (operating oil pressure) exceeding the actuator operating pressure (rotation motor activation pressure) Pm is supplied from the control valve 70 to the actuator 72, the actuator 72 can be slowly activated even in the emergency operation.

Further, by further depressing the accelerator 81, the discharge amount of the hydraulic pump 71 can further increase, and the speed of the actuator 72 can increase. Naturally, by loosening the accelerator 81, the speed of the actuator 72 can be lowered to slowly stop.

Incidentally, the pump pressure Pp during the idling may be slightly higher than the actuator operating pressure Pm within a range where the actuator 72 does not suddenly operate.

In the mobile crane 40, since the mobile crane can be slowly activated/slowly stopped even when the rotation emergency operation is performed in the crane working posture illustrated in FIG. 1, there is no concern that the suspended load 52 swings largely and strikes the telescopic boom 45. Therefore, it is possible to perform the emergency operation safely.

Thus, the hydraulic system 60 includes the hydraulic pump 71, the pilot-type control valve 70 which supplies the pump pressure Pp (operating oil pressure) from the hydraulic pump 71 to the actuator 72 of the working machine, the electromagnetic proportional valve 63 which supplies a pilot pressure to the control valve 70, the operation lever 61 which receives an operation for operating the actuator 72, the controller 62 which controls the electromagnetic proportional valve 63 based on an operation signal from the operation lever 61, and the pilot pressure switching unit 64 which can switch the electromagnetic proportional valve supply pressure supplied from the pilot pressure source 65 to the electromagnetic proportional valve 63 to a first pressure during the normal operation or a second pressure lower than the first pressure. The control valve 70 has the bleed-off passage 73 whose opening area increases and decreases according to the stroke of the spool based on a pilot pressure, and can control the pump pressure Pp which is supplied to the actuator 72 according to the opening area. The second pressure is set such that the pump pressure Pp is equal to or lower than a predetermined pressure when the electromagnetic proportional valve supply pressure is switched to the second pressure in a state where the operating oil discharge amount of the hydraulic pump 71 is the minimum discharge amount. The pilot pressure switching unit 64 switches the electromagnetic proportional valve supply pressure from the first pressure to the second pressure during the emergency operation in which the control of the electromagnetic proportional valve 63 by the controller 62 is not possible. The electromagnetic proportional valve is set to the fully opened state during the emergency operation. Further, as the operating oil discharge amount from the hydraulic pump 71 increases and decreases, the pump pressure Pp increases and decreases, and the operation speed of the actuator 72 is controlled.

Specifically, the hydraulic system 60 includes the emergency operation circuit 84 which controls the electromagnetic proportional valve 63 to the fully opened state based on the operation signal from the operation lever 61 during the emergency operation.

In addition, the set pressure (second pressure) during the decompression in the pilot pressure switching unit 64 is set based on the actuator operating pressure Pm of the actuator 72. For example, the second pressure is set such that the pump pressure Pp (operating oil pressure) is equal to or lower than (may slightly exceed) the actuator operating pressure Pm in a state where the operating oil discharge amount of the hydraulic pump 71 is the minimum discharge amount. In other words, the predetermined pressure which is the comparison reference of the pump pressure Pp is a pressure at which the actuator 72 does not operate or slowly operates, and is the actuator operating pressure Pm or a value slightly higher than the actuator operating pressure Pm.

Further, in the present embodiment, the power source of the hydraulic pump 71 is the engine 80 of the mobile crane 40 (working machine). The second pressure is set such that the pump pressure Pp (operating oil pressure) is equal to or lower than the predetermined pressure when the electromagnetic proportional valve supply pressure is switched to the second pressure in a state where the engine 80 is in the idling state. The operating oil discharge amount from the hydraulic pump 71 increases and decreases by operating the accelerator 81 which increases and decreases the rotational speed of the engine 80.

Since the hydraulic system 60 can slowly drive the actuator 72 during the emergency operation, the hydraulic system is extremely excellent in safety.

Figure 6:
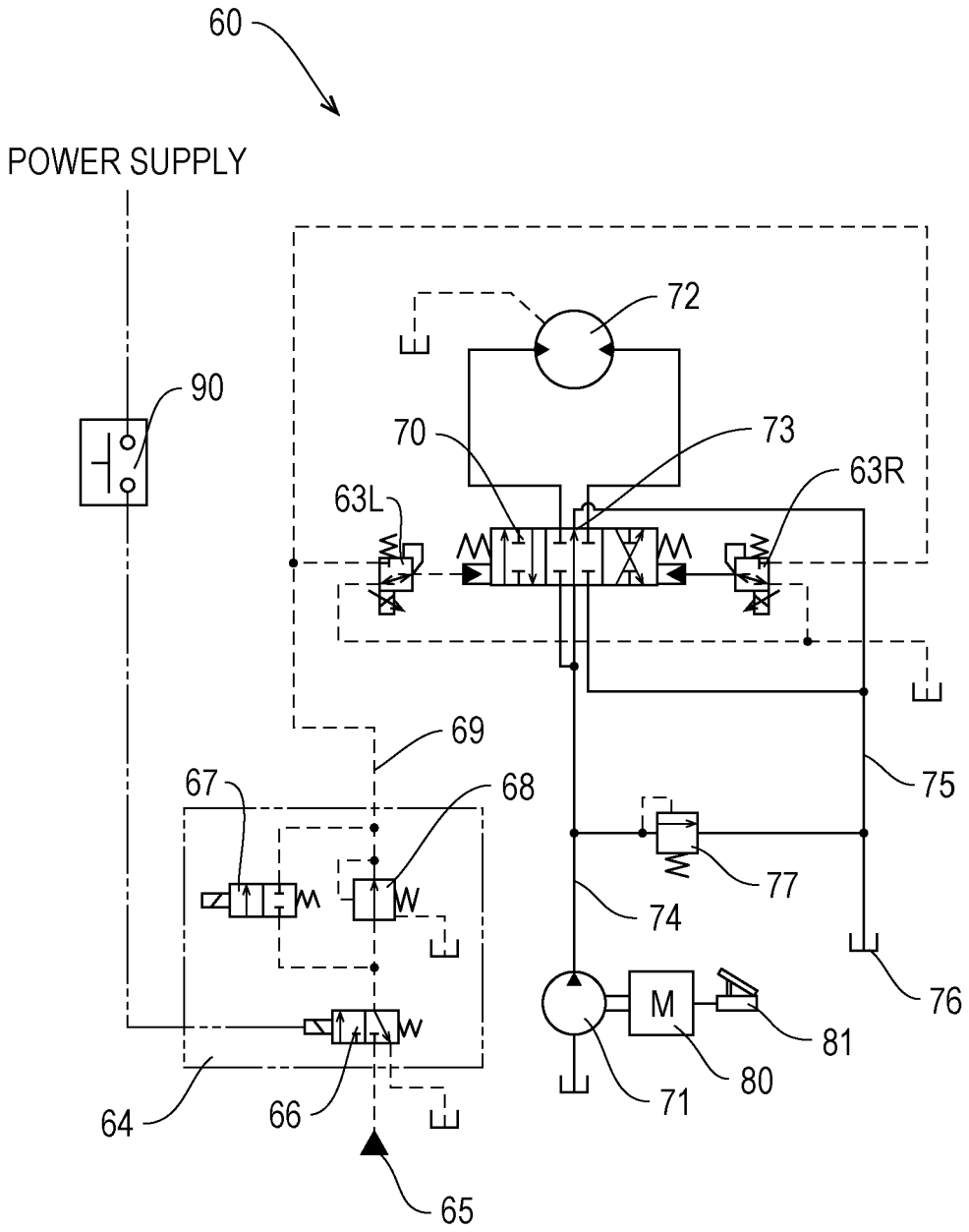
FIG. 6 is a diagram illustrating another example of a control system of an electric operation system in a case where an electromagnetic proportional valve breaks down.

FIG. 6 is a diagram illustrating another example of the control system of the electric operation system in a case where the electromagnetic proportional valve 63 breaks down. As a case where the electromagnetic proportional valve 63 breaks down, it is considered that the electromagnetic proportional valve 63 is disconnected, or the electromagnetic proportional valve 63 is stuck by contamination. In this case, the electromagnetic proportional valve 63 cannot be moved by electricity.

The electromagnetic proportional valves 63L and 63R have a detent type emergency manual operation function. The electromagnetic proportional valves 63L and 63R can be fixed in a state where the oil passage is opened by using an emergency operation screw or the like provided in the electromagnetic proportional valve. An emergency operation activation switch 90 is provided in an operating room 53 of the mobile crane 40. The emergency operation activation switch 90 is a momentary type switch. While the emergency operation activation switch 90 is pressed, power is supplied to the first electromagnetic switching valve 66 of the pilot pressure switching unit 64 from the power supply. Other configurations of the hydraulic system 60 illustrated in FIG. 6 are the same as those during the normal state described with reference to FIG. 2, so that the description thereof is omitted.

The emergency operation in a case where the electromagnetic proportional valve 63L breaks down is as follows.

First of all, the operator forcibly brings the electromagnetic proportional valve 63L into a fully opened state by operating a push pin or an emergency operation screw of the electromagnetic proportional valve 63L in a direction in which the actuator 72 (for example, rotation motor) to be moved is to be moved.

Next, the operator operates the emergency operation activation switch 90 in the operating room and switches the first electromagnetic switching valve 66 of the pilot pressure switching unit 64 to the communication side. Then, the electromagnetic proportional valve supply pressure of the pilot pressure source 65 is decompressed to a predetermined pressure (second pressure) by passing through the first electromagnetic switching valve 66 and the decompression valve 68 and is supplied to the pilot oil passage 69. Then, the decompression pilot pressure is supplied from the pilot oil passage 69 to the control valve 70 via the electromagnetic proportional valve 63L (for left rotation) in a fully opened state. The subsequent emergency operation is the same as the emergency operation in the control system in a case where the electric circuit breaks down illustrated in FIG. 3.

As described above, in the hydraulic system 60, even in a case where the electromagnetic proportional valve 63 breaks down, by applying further decompressed pilot pressure compared with a pilot pressure during the normal operation to the control valve 70 including the bleed-off passage 73, during the idling, the control valve 70 can be switched to such an extent that the pump pressure Pp generated by the operating oil passing through the bleed-off passage 73 of the control valve 70 does not exceed the actuator operating pressure Pm. In addition, when the pump discharge amount Q increases, the pump pressure Pp generated by the operating oil passing through the bleed-off passage 73 of the control valve 70 increases. Accordingly, the pump pressure Pp (operating oil pressure) exceeding the actuator operating pressure Pm is supplied from the control valve 70 to the actuator 72, so that the actuator 72 can be slowly activated even during an emergency operation.

By further controlling the accelerator 81, the discharge amount of the hydraulic pump 71 can further increase and decrease, and the speed of the actuator 72 can increase and decrease. Naturally, by loosening the accelerator 81, the speed of the actuator 72 can be lowered to slowly stop the actuator. Incidentally, the pump pressure Pp during the idling may be slightly higher than the operating pressure Pm within a range in which the actuator 72 does not suddenly operate.

Since the mobile crane 40 can be slowly activated/slowly stopped even when performing the rotation operation during the emergency in the crane working posture illustrated in FIG. 1, there is no concern that the suspended load 52 swings largely and strikes the telescopic boom 45. Therefore, it is possible to perform the emergency operation safely.

Although the invention made by the present inventor has been specifically described above based on the embodiment, the present invention is not limited to the above embodiment and can be modified within a range not departing from the gist thereof.

In the two embodiments described above, as an example during the emergency operation in which the controller 62 cannot control the electromagnetic proportional valve 63, a case where the electric circuit breaks down and a case where the electromagnetic proportional valve breaks down have been described. In other words, in a case where the electric circuit or the electromagnetic proportional valve breaks down, the decompression pilot pressure based on the electromagnetic proportional valve supply pressure (the second pressure) decompressed by the pilot pressure switching unit 64 is applied to the control valve 70 including the bleed-off passage 73 via the pilot oil passage 69 and the electromagnetic proportional valve 63 in the fully opened state. In addition, the operating oil discharge amount from the hydraulic pump 71 increases, and the actuator 72 is slowly activated/slowly stopped. Further, the following application utilizing the technical idea of the present invention is also possible.

In other words, during the emergency operation, when the operation lever 61 is operated, a drive signal may be output from the controller 62 to the electromagnetic proportional valve 63 so as to apply a pilot pressure which becomes the spool stroke Se (bleed-off passage area Ae) illustrated in FIG. 4 to the control valve 70. In the operation signal, since information corresponding to the drive amount of the operation lever 61 is not transmitted to the electromagnetic proportional valve 63, this case is also included in an example during the emergency operation where the control of the electromagnetic proportional valve 63 by the controller 62 is not possible.

Also, in this case, the control valve 70 can be switched to such an extent that the pump pressure Pp generated by the operating oil passing through the bleed-off passage 73 of the control valve 70 does not exceed the actuator operating pressure Pm. In addition, when the pump discharge amount Q increases, the pump pressure Pp generated by the operating oil passing through the bleed-off passage 73 of the control valve 70 increases. Accordingly, the pump pressure Pp exceeding the actuator operating pressure Pm is supplied from the control valve 70 to the actuator 72, so that the actuator 72 can be slowly activated even during the emergency operation.

Further, by further depressing the accelerator 81, the discharge amount of the hydraulic pump 71 can further increase and decrease, and the speed of the actuator 72 can increase and decrease. Naturally, by loosening the accelerator, the speed of the actuator 72 can be reduced to slowly stop the actuator. Incidentally, the pump pressure Pp during the idling may be slightly higher than the operating pressure Pm within a range in which the actuator 72 does not suddenly operate.

In addition, in the embodiment, although the operating oil discharge amount of the fixed displacement type hydraulic pump 71 increases and decreases by increasing and decreasing the engine rotational speed by the accelerator 81, the hydraulic pump may be configured by a variable displacement type hydraulic pump, and the discharge amount per rotation may be changed.

It should be considered that the embodiment disclosed this time is an example in all respects and it is not restrictive. The range of the present invention is defined not by the above description but by the range of the claims, and it is intended that all modifications within meaning and range equivalent to the claims are included.

The disclosure content of the specification, drawings, and abstract included in the Japanese Patent Application No. 2016-070733 filed on Mar. 31, 2016 is incorporated herein by reference in its entirety.

REFERENCE SIGNS LIST

60 HYDRAULIC SYSTEM
61 OPERATION LEVER
62 CONTROLLER
63 ELECTROMAGNETIC PROPORTIONAL VALVE
64 PILOT PRESSURE SWITCHING UNIT
70 CONTROL VALVE
71 HYDRAULIC PUMP
72 ACTUATOR
73 BLEED-OFF PASSAGE
80 ENGINE
81 ACCELERATOR
84 EMERGENCY OPERATION CIRCUIT

The invention claimed is:

1. A hydraulic system comprising:
a hydraulic pump;
a pilot-type control valve which supplies an operating oil pressure from the hydraulic pump to an actuator of a working machine;
a pilot pressure source;
an electromagnetic proportional valve which supplies a pilot pressure to the control valve when receiving an electromagnetic proportional valve supply pressure from the pilot pressure source;
an operation lever which receives an operation for operating the actuator;
a controller which controls the electromagnetic proportional valve based on an operation signal from the operation lever; and
a pilot pressure switching unit in which the electromagnetic proportional valve supply pressure is capable of being switched,
wherein the control valve has a bleed-off passage whose opening area increases and decreases according to a stroke of a spool based on the pilot pressure, and is capable of controlling the operating oil pressure to be supplied to the actuator according to the opening area, and
during an emergency operation in which the controller is not capable of controlling the electromagnetic proportional valve,
the electromagnetic proportional valve is brought into a fully opened state,
the pilot pressure switching unit switches the electromagnetic proportional valve supply pressure from a first pressure to a second pressure in order to prevent generation of the operating oil pressure capable of activating the actuator, when an operating oil with a minimum discharge amount passes through the bleed-off passage, the first pressure being a pressure during normal operation, the second pressure being a pressure smaller than the first pressure,
the control valve is operated by the pilot pressure based on the second pressure through the electromagnetic proportional valve, and
as the operating oil discharge amount from the hydraulic pump increases and decreases, the operating oil pressure increases and decreases, and an operation speed of the actuator is controlled.

2. The hydraulic system according to claim 1, further comprising:
an emergency operation circuit which controls the electromagnetic proportional valve to the fully opened state based on an operation signal from the operation lever during the emergency operation.

3. The hydraulic system according to claim 1, wherein the electromagnetic proportional valve has a detent type emergency manual operation function and is manually switched to the fully opened state during the emergency operation.

4. The hydraulic system according to claim 1,
wherein the hydraulic pump is of a fixed displacement type,
a power source of the hydraulic pump is an engine of the working machine, and
the operating oil discharge amount from the hydraulic pump increases and decreases by an accelerator operation which increases and decreases a rotational speed of the engine.

5. An emergency operation method of a hydraulic system, wherein the hydraulic system includes:
a hydraulic pump;
a pilot-type control valve which supplies an operating oil pressure from the hydraulic pump to an actuator of a working machine;
a pilot pressure source;
an electromagnetic proportional valve which supplies a pilot pressure to the control valve when receiving an electromagnetic proportional valve supply pressure from the pilot pressure source;
an operation lever which receives an operation for operating the actuator;
a controller which controls the electromagnetic proportional valve based on an operation signal from the operation lever; and
a pilot pressure switching unit in which the electromagnetic proportional valve supply pressure is capable of being switched,
wherein the control valve has a bleed-off passage whose opening area increases and decreases according to a stroke of a spool based on the pilot pressure, and is capable of controlling the operating oil pressure to be supplied to the actuator according to the opening area, and
wherein the emergency operation method comprises:
during an emergency operation in which the controller is not capable of controlling the electromagnetic proportional valve,
a step of bringing the electromagnetic proportional valve into a fully opened state;
a step of switching the electromagnetic proportional valve supply pressure from a first pressure to a second pressure in order to prevent generation of the operating oil pressure capable of activating the actuator, when an operating oil with a minimum discharge amount passes through the bleed-off passage, the first pressure being a pressure during a normal operation, the second pressure being a pressure smaller than the first pressure;

a step of operating the control valve by the pilot pressure based on the second pressure through the electromagnetic proportional valve in the fully opened state; and a step of, by increasing and decreasing the operating oil discharge amount from the hydraulic pump, increasing and decreasing the operating oil pressure and controlling an operation speed of the actuator.

* * * * *